US010705444B2

(12) United States Patent
Tominaga et al.

(10) Patent No.: US 10,705,444 B2
(45) Date of Patent: Jul. 7, 2020

(54) IMAGE FORMING APPARATUS AND IMAGE STRUCTURE

(71) Applicant: FUJI XEROX CO., LTD., Tokyo (JP)

(72) Inventors: Yoshiyuki Tominaga, Kanagawa (JP); Masaaki Yamaura, Kanagawa (JP); Jun Kuwabara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/262,940

(22) Filed: Jan. 31, 2019

(65) Prior Publication Data

US 2020/0096890 A1 Mar. 26, 2020

(30) Foreign Application Priority Data

Sep. 25, 2018 (JP) ..... 2018-178606

(51) Int. Cl.
*G03G 15/01* (2006.01)
*G03G 15/16* (2006.01)
(Continued)

(52) U.S. Cl.
CPC ..... *G03G 15/0131* (2013.01); *G03G 15/0189* (2013.01); *G03G 15/1605* (2013.01);
(Continued)

(58) Field of Classification Search
CPC ..... G03G 15/0131; G03G 15/6585; G03G 2215/0636
See application file for complete search history.

(56) References Cited

U.S. PATENT DOCUMENTS 7,933,528 B2 4/2011 Yoshioka et al.
2012/0219309 A1* 8/2012 Yoshioka ..... G03G 15/1605 399/45

(Continued)

FOREIGN PATENT DOCUMENTS

JP 2010-224126 10/2010
JP 4962196 6/2012
JP 2012-173520 9/2012

*Primary Examiner* — Thomas S Giampaolo, II
(74) *Attorney, Agent, or Firm* — JCIPRNET

(57) ABSTRACT

An image forming apparatus includes an intermediate transfer unit that holds an image to be transferred onto a recording medium, a base image formation unit that forms a planar base image onto the intermediate transfer unit by using an opaque base image forming agent, the base image being brought into contact with and disposed onto an entire surface of the recording medium or a partial region of the surface of the recording medium, a transparent image formation unit that forms a transparent image onto the intermediate transfer unit by using a transparent image forming agent, a first control unit that performs control for transferring a monochromatic or polychromatic image including the base image formed on the intermediate transfer unit by the base image formation unit onto the recording medium, a second control unit that performs control for superposing a monochromatic or polychromatic image including the base image formed by the base image formation unit onto the transparent image formed on the intermediate transfer unit by the transparent image formation unit and for transferring a monochromatic or polychromatic image including the transparent image and the base image onto the recording medium, and a selection unit that selects the first control unit or the second control unit depending on a recording medium type.

18 Claims, 14 Drawing Sheets

(51) Int. Cl.
*G03G 15/20* (2006.01)
*G03G 15/00* (2006.01)

(52) U.S. Cl.
CPC ..... *G03G 15/2064* (2013.01); *G03G 15/5004* (2013.01); *G03G 15/5029* (2013.01); *G03G 2215/00763* (2013.01); *G03G 2215/0122* (2013.01)

(56) References Cited

U.S. PATENT DOCUMENTS

2015/0029518 A1* 1/2015 Tashiro ..... G03G 15/01 358/1.1
2016/0054669 A1* 2/2016 Hori ..... G03G 9/0827 399/223
2016/0154345 A1* 6/2016 Nagata ..... G03G 15/1665 399/315

* cited by examiner

IMAGE FORMING APPARATUS AND IMAGE STRUCTURE

CROSS-REFERENCE TO RELATED APPLICATIONS

This application is based on and claims priority under 35 USC 119 from Japanese Patent Application No. 2018-178606 filed Sep. 25, 2018.

BACKGROUND

(i) Technical Field

The present disclosure relates to an image forming apparatus and an image structure.

(ii) Related Art

For example, an image forming method and image forming apparatuses described in Japanese Unexamined Patent Application Publication No. 2012-173520 (Description of Embodiments, FIG. 1), Japanese Patent No. 4962196 (Best Mode for Carrying out the Invention, FIG. 1, FIG. 7), and Japanese Unexamined Patent Application Publication No. 2010-224126 (Best Mode for Carrying out the Invention, FIG. 1, FIG. 7) have been already known in the related art.

Japanese Unexamined Patent Application Publication No. 2012-173520 discloses an image forming method of providing a clear toner layer onto at least one of chromatic color toner layers formed on an image support.

Japanese Patent No. 4962196 discloses an image forming apparatus in which a base toner image is formed only in a region that corresponds to a monochromatic color toner image formed by a second image forming unit and in which the developing amount of the base toner image in a region corresponding to a central portion is smaller than the developing amount of the base toner image in a region corresponding to an end portion.

Japanese Unexamined Patent Application Publication No. 2010-224126 discloses an image forming apparatus in which, when a color toner image is formed onto a clear toner image formed on an intermediate transfer body, the color toner image is formed by using a threshold of a solid image density as an upper limit in accordance with the type of a recording medium.

SUMMARY

Aspects of non-limiting embodiments of the present disclosure relate to suppressing occurrence of a transfer failure of an image that is formed on the basis of an instruction from a user regarding a recording medium that reduces the transferability of an image, whereas in the case where a monochromatic or polychromatic image including a base image is formed onto a surface of a recording medium by uniformly transferring the image onto the recording medium regardless of the type of the recording medium and without using a transparent image formation unit, occurrence of a transfer failure will not be suppressed.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including an intermediate transfer unit that holds an image to be transferred onto a recording medium, a base image formation unit that forms a planar base image onto the intermediate transfer unit by using an opaque base image forming agent, the base image being brought into contact with and disposed onto an entire surface of the recording medium or a partial region of the surface of the recording medium, a transparent image formation unit that forms a transparent image onto the intermediate transfer unit by using a transparent image forming agent, a first control unit that performs control for transferring a monochromatic or polychromatic image including the base image formed on the intermediate transfer unit by the base image formation unit onto the recording medium, a second control unit that performs control for superposing a monochromatic or polychromatic image including the base image formed by the base image formation unit onto the transparent image formed on the intermediate transfer unit by the transparent image formation unit and for transferring a monochromatic or polychromatic image including the transparent image and the base image onto the recording medium, and a selection unit that selects the first control unit or the second control unit depending on a recording medium type.

BRIEF DESCRIPTION OF THE DRAWINGS

Exemplary embodiments of the present disclosure will be described in detail based on the following figures, wherein.

DETAILED DESCRIPTION

Overview of Exemplary Embodiment

Figure 1A:
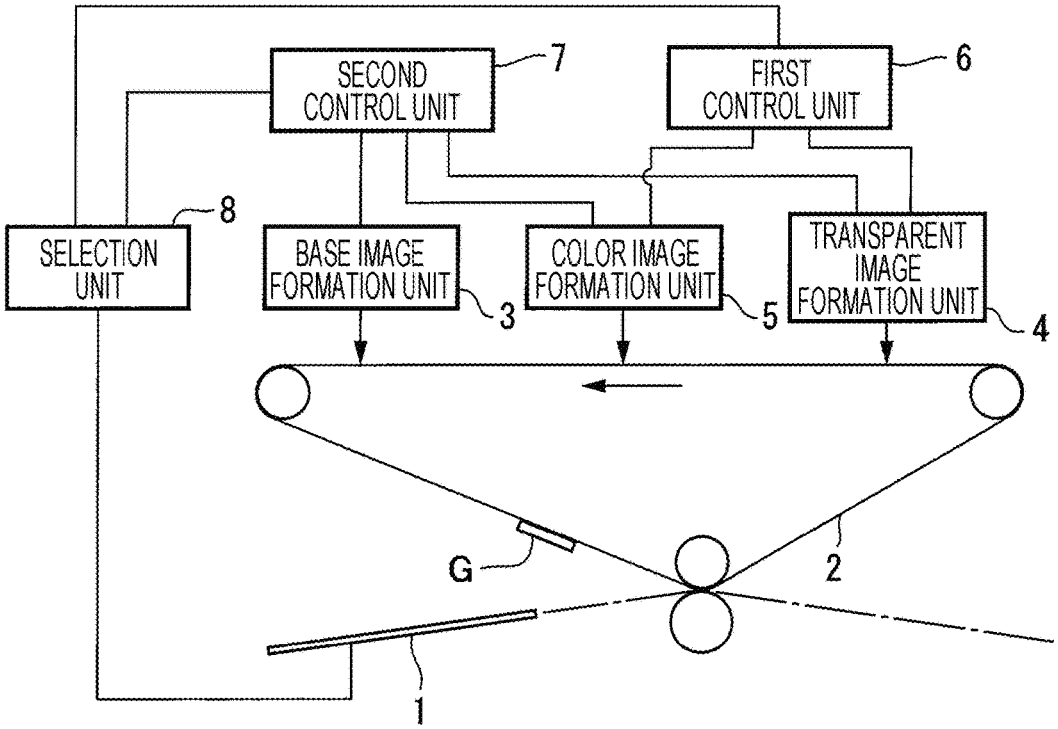
FIG. 1A is a diagram illustrating an overview of an image forming apparatus according to an exemplary embodiment of the present disclosure.

FIG. 1A is a diagram illustrating an overview of an image forming apparatus according to an exemplary embodiment of the present disclosure.

Figure 1B:
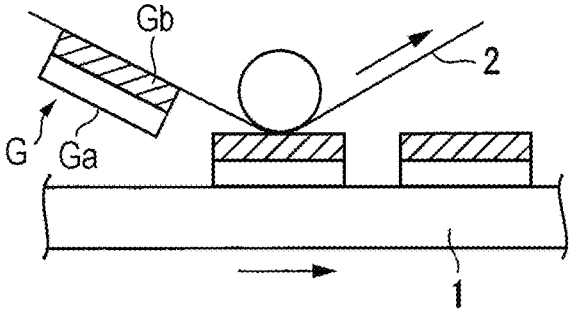
FIG. 1B is a diagram illustrating an overview of first control processing.

In FIG. 1A, an image forming apparatus 20 includes an intermediate transfer unit 2 that holds an image G that is transferred onto a recording medium 1, a base image formation unit 3 that forms a planar base image Ga (see FIGS. 1B and 1C) onto the intermediate transfer unit 2 by using an opaque base image forming agent, the base image Ga being brought into contact with and disposed onto the entire surface of the recording medium 1 or a partial region of the surface of the recording medium 1, a transparent image formation unit 4 that forms a transparent image Gc (see FIG. 1C) onto the intermediate transfer unit 2 by using a transparent image forming agent, a first control unit 6 that performs control for transferring a monochromatic or polychromatic image including the base image Ga, which has been formed on the intermediate transfer unit 2 by the base image formation unit 3, onto the recording medium 1 as illustrated in FIG. 1B, a second control unit 7 that performs control for superposing a monochromatic or polychromatic image including the base image Ga formed by the base image formation unit 3 onto the transparent image Gc formed on the intermediate transfer unit 2 by the transparent image formation unit 4 and for transferring a monochromatic or polychromatic image that includes the transparent image Gc and the base image Ga onto the recording medium 1, and a selection unit 8 that selects the first control unit 6 or the second control unit 7 depending on the type of the recording medium 1.

Note that the term "image formation" used in the "base image formation unit 3" and the "transparent image formation unit 4" refers to forming an image, and the term "image formation" will hereinafter be used as a term having a similar definition to "forming an image".

In such technical measure, the base image Ga may be any planar image as long as the image is formed by using an opaque base image forming agent and is brought into contact with and disposed onto the entire surface of the recording medium 1 or a partial region of the surface of the recording medium 1. Although the base image Ga may be a planar image, the area coverage thereof is not necessarily 100%.

In addition, the first control unit 6 may be any functional unit as long as the unit controls image formation processing that does not use the transparent image Gc, and the second control unit 7 may be any functional unit as long as the unit controls image formation processing that uses the transparent image Gc.

Furthermore, the wording "a monochromatic or polychromatic image including the base image Ga" implies that, in addition to a monochromatic image formed of only the base image Ga, a polychromatic image formed by superposing a color image Gb (see FIGS. 1B and 1C) onto the base image Ga are also to be formed. Note that a specific example of the polychromatic image will be described later.

The selection unit 8 may be any functional unit as long as the functional unit automatically or manually selects the first control unit 6 or the second control unit 7 depending on the type of the recording medium 1.

A representative example or an example of the image forming apparatus 20 according to the present exemplary embodiment will now be described.

Figure 1C:
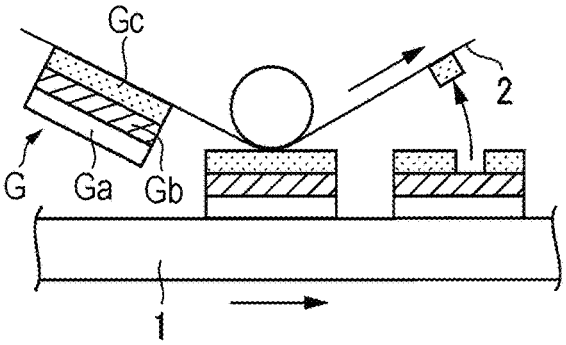
FIG. 1C is a diagram illustrating an overview of second control processing.

In the present exemplary embodiment, as a representative example, the image forming apparatus 20 includes a color image formation unit 5 that forms the color image Gb onto the intermediate transfer unit 2 by using one or a plurality of color image forming agents excluding the transparent image forming agent as illustrated in FIGS. 1A to 1C. As an example, the first control unit 6 performs control for superposing the base image Ga formed by the base image formation unit 3 onto the color image Gb formed on the intermediate transfer unit 2 by the color image formation unit 5 and for transferring a polychromatic image that includes the color image Gb and the base image Ga onto the recording medium 1, and the second control unit 7 performs control for superposing the polychromatic image including the color image Gb formed by the color image formation unit 5 and the base image Ga formed by the base image formation unit 3 onto the transparent image Gc formed on the intermediate transfer unit 2 by the transparent image formation unit 4 and for transferring a polychromatic image that includes the transparent image Gc, the color image Gb, and the base image Ga onto the recording medium 1. In the present exemplary embodiment, the image forming apparatus 20 includes the color image formation unit 5, and the first control unit 6 and the second control unit 7 are embodied.

As an example, the base image Ga has a weight per unit area larger than that of a color image layer of at least one color component of the color image Gb. As the present exemplary embodiment, in the case where the base image Ga has a large weight per unit area, the surface of the recording medium 1 is completely covered with the base image Ga, and thus, there is no concern about exposure of the surface of the recording medium 1 at a portion of the base image Ga.

Here, as an example, the base image forming agent has an average particle diameter larger than that of the transparent image forming agent or that of the color image forming agent. The present exemplary embodiment focuses on the particle diameter of the base image forming agent in order to ensure the weight per unit area of the base image Ga.

As another example, the base image forming agent includes a spot color that is different from the color image forming agent. The present exemplary embodiment is intended to improve the image quality of the color image Gb with respect to a background portion of the base image Ga by using the base image forming agent that includes a spot color different from the color image forming agent.

In this case, as an example, the base image forming agent is white.

In addition, in the image forming apparatus 20 that includes a fixing unit (not illustrated in FIGS. 1A to 1C), which fixes an image that has been transferred to the recording medium 1 onto the recording medium 1, as a representative example, when the base image Ga has an area coverage of 80% or more, the base image Ga becomes a solid image after being fixed in position by the fixing unit. In the present exemplary embodiment, the fixing unit is not limited to employing a heating-and-pressurizing method, and examples of the method employed by the fixing unit widely include a heating method, a pressurizing method, and the like. The base image Ga does not need to have an area coverage of 100%, and an area coverage of 90% to 95% is sufficient. For example, in the case where the base image forming agent has a high thermal melting property, the base image Ga becomes a solid image after being fixed in position even if the area coverage of the base image Ga is 80%, and thus, the base image Ga may be formed also in this case.

As an example, the second control unit 7 weakens a transfer electric field more than the first control unit 6 does. As illustrated in FIG. 1C, the second control unit 7 is configured to form a monochromatic or polychromatic image including the base image Ga onto the intermediate transfer unit 2 with the transparent image Gc interposed between the monochromatic or polychromatic image and the intermediate transfer unit 2 and is configured to transfer the images onto the recording medium 1 by using a transfer electric field, and even if a portion of the transparent image Gc that is in contact with the intermediate transfer unit 2 remains untransferred, this does not directly affect the quality of the transferred image. Therefore, the second control unit 7 may weaken a transfer electric field more than the first control unit 6 does.

As an example, the first control unit 6 and the second control unit 7 are automatically selected by the selection unit 8. In the present exemplary embodiment, the first control unit 6 or the second control unit 7 is automatically selected depending on the type of the recording medium 1.

In addition, as a representative example, the selection unit 8 selects the second control unit 7 when the recording medium 1 has a high resistance value that is equal to or higher than a predetermined resistance value and includes a conductive agent contained in a medium base material thereof. In the present exemplary embodiment, when the recording medium 1 has a high resistance value and includes a conductive agent, the second control unit 7 is selected. In the present exemplary embodiment, although the "predetermined resistance value" may be suitably selected, when the surface resistance value of the recording medium 1 is higher than 10 log Ω, a transfer failure of a polychromatic image (a superposed image) is likely to occur, and thus, 11 log Ω may be selected as the predetermined resistance value (see Examples).

As another representative example, the selection unit 8 selects the second control unit 7 when the recording medium 1 has a high resistance that is equal to or higher than the predetermined resistance and has black color. In the present exemplary embodiment, when the recording medium 1 has a high resistance and is black, the second control unit 7 is selected.

As another representative example, the selection unit 8 selects the second control unit 7 when the recording medium 1 has a high resistance value that is equal to or higher than the predetermined resistance value and includes carbon black contained in the medium base material thereof. In the present exemplary embodiment, considering that carbon black that is internally added as a conductive agent to the recording medium 1 is the reason why the recording medium 1 is black in many cases, the second control unit 7 is selected when the recording medium 1 has a high resistance value and includes carbon black.

In the present exemplary embodiment, an image structure that is formed on the special recording medium 1 is also novel.

In other words, as illustrated in FIGS. 1B and 1C, the image structure according to the present exemplary embodiment is an image structure that is obtained by transferring an image, which has been formed on the intermediate transfer unit 2, onto the recording medium 1 having a high resistance value that is equal to or higher than the predetermined resistance value and including a conductive agent contained in the medium base material thereof, by using the image forming apparatus 20, which includes the intermediate transfer unit 2 that holds an image to be transferred onto the recording medium 1, the base image formation unit 3 that forms the base image Ga onto the intermediate transfer unit 2 by using the base image forming agent excluding the transparent image forming agent, the base image Ga being brought into contact with and disposed onto the entire surface of the recording medium 1 or a partial region of the surface of the recording medium 1, the transparent image formation unit 4 that forms the transparent image Gc onto the intermediate transfer unit 2 by using the transparent image forming agent, and the color image formation unit 5 that forms the color image Gb onto the intermediate transfer unit 2 by using one or a plurality of color image forming agents excluding the transparent image forming agent. In the image structure, the transparent image Gc is directly superposed on the base image Ga on the surface of the recording medium 1 or is superposed on the base image Ga on the surface of the recording medium 1 with the color image Gb interposed between the transparent image Gc and the base image Ga.

Here, as an example, in the image structure, the base image Ga has a weight per unit area larger than that of a color image layer of at least one color component of the color image Gb.

The exemplary embodiment of the present disclosure will be described in further detail below with reference to the accompanying drawings.

Exemplary Embodiment

Figure 2:
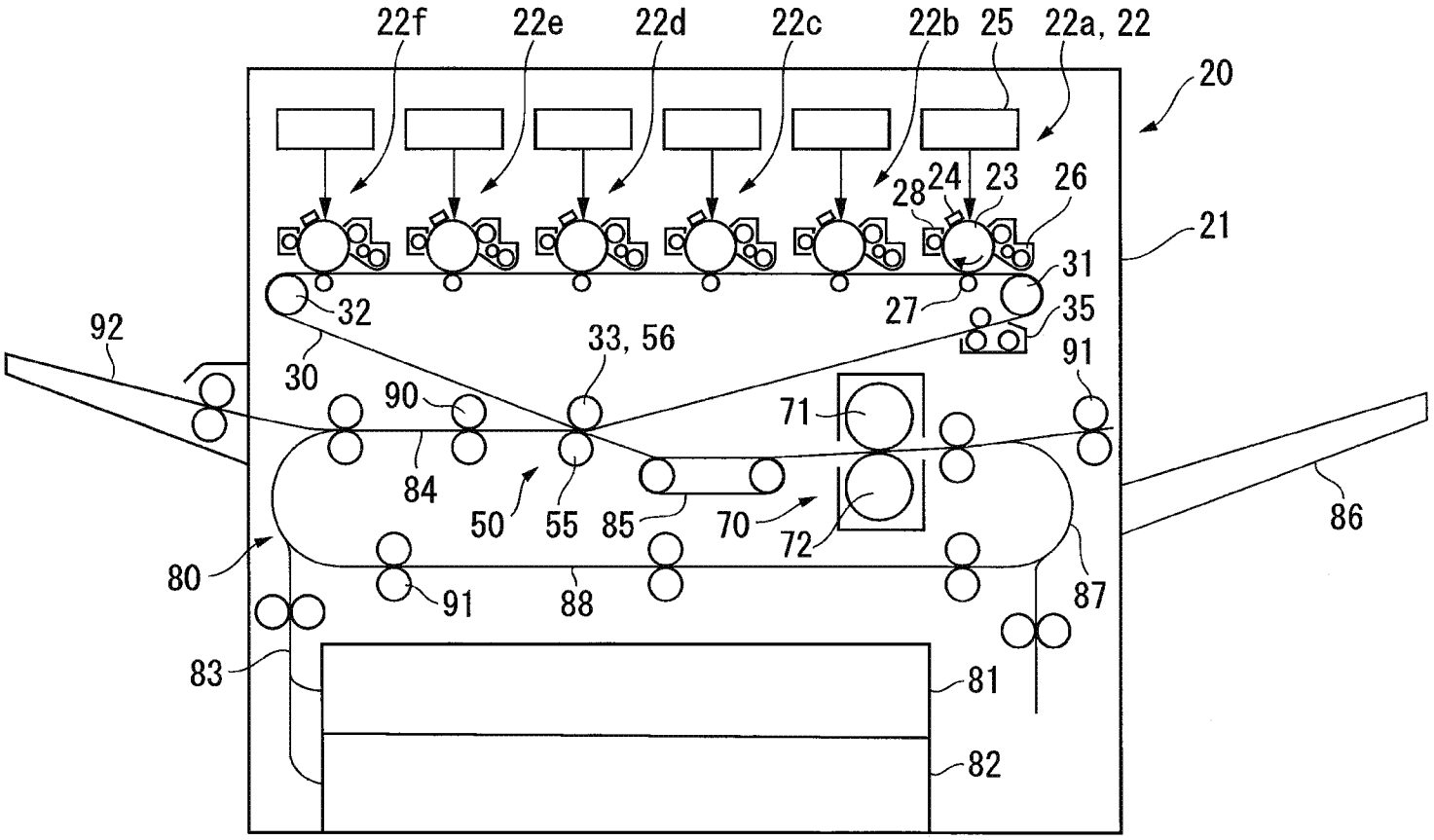
FIG. 2 is a diagram illustrating an overall configuration of the image forming apparatus according to the exemplary embodiment.

FIG. 2 is a diagram illustrating the overall configuration of the image forming apparatus according to the exemplary embodiment.

Overall Configuration of Image Forming Apparatus

In FIG. 2, the image forming apparatus 20 includes, in an image forming apparatus housing 21 thereof, image forming units 22 (specifically, 22*a* to 22*f*) that form images each having one of a plurality of color components (clear (CL), yellow (Y), magenta (M), cyan (C), black (K), and white (W) in the present exemplary embodiment), a belt-shaped intermediate transfer body 30 that holds the images of the different color components that are formed by the image forming units 22 and that are sequentially transferred (in a first transfer process) onto the intermediate transfer body 30, a second transfer device (a collective transfer device) 50 that transfers in a second transfer process (collectively transfers) the images of the different color components, which have been transferred to the intermediate transfer body 30, onto a sheet that serves as a recording medium, a fixing device 70 that fixes the images, which have been transferred in the second transfer process to the sheet, onto the sheet, and a sheet transport system 80 that transports the sheet to a second transfer region.

Image Forming Unit

In the present exemplary embodiment, each of the image forming units 22 (22*a* to 22*f*) includes a drum-shaped photoconductor 23, and the following devices are disposed around the photoconductor 23: a charging device 24, such as a corotron or a transfer roller, that charges the photoconductor 23, an exposure device 25, such as a laser-scanning device, that writes an electrostatic latent image onto the charged photoconductor 23, a developing device 26 that develops the electrostatic latent image written on the photoconductor 23 with a corresponding one of color component toners, a first transfer device 27, such as a transfer roller, that transfers the toner image formed on the photoconductor 23 onto the intermediate transfer body 30, and a photoconductor cleaning device 28 that removes residual toner on the photoconductor 23.

The intermediate transfer body 30 is stretched by a plurality of (three in the present exemplary embodiment) stretching rollers 31 to 33. For example, the stretching roller 31 is used as a driving roller that is driven by a drive motor (not illustrated), and the intermediate transfer body 30 is caused to move circularly by the driving roller. In addition, an intermediate-transfer-body cleaning device 35 that removes residual toner on the intermediate transfer body 30 after the second transfer process is disposed between the stretching rollers 31 and 33.

Second Transfer Device (Collective Transfer device)

Figure 3:
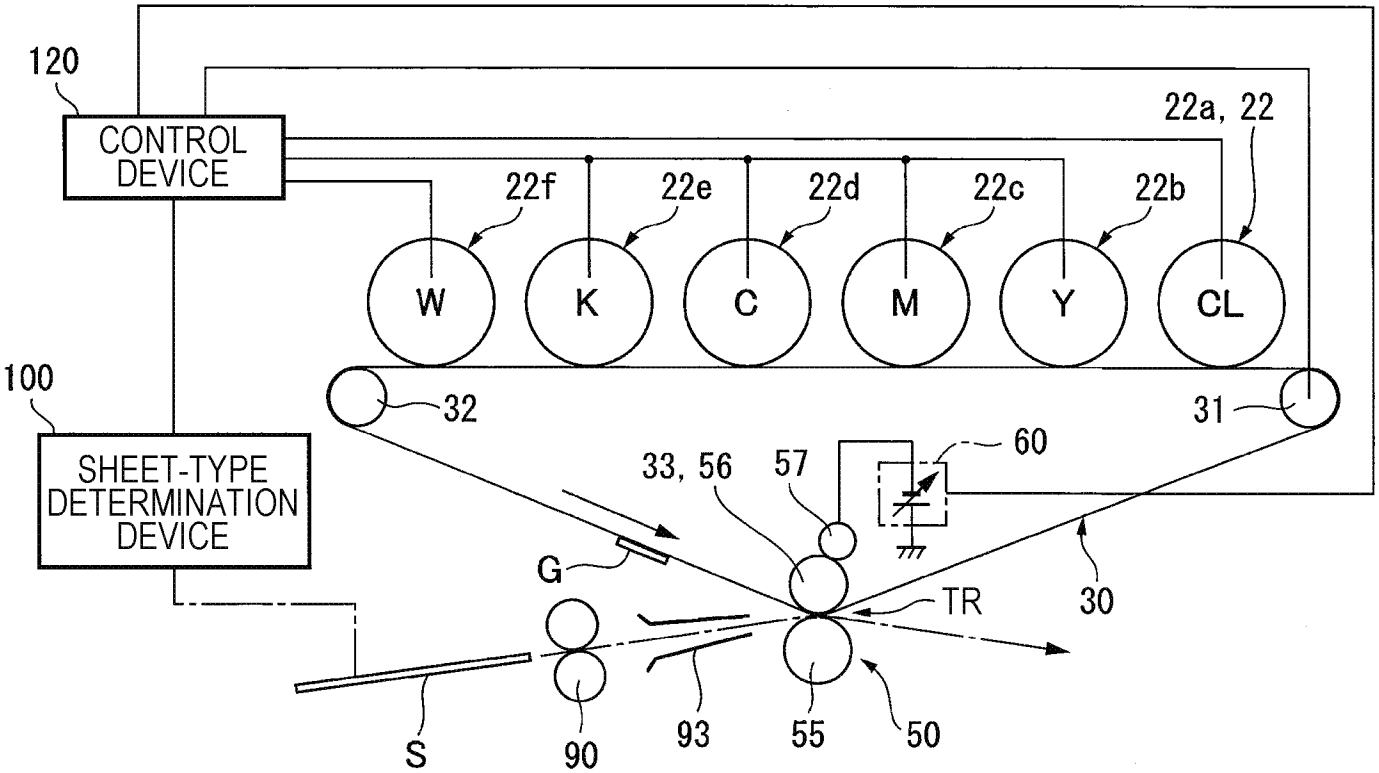
FIG. 3 is a diagram illustrating a control system of the image forming apparatus according to the exemplary embodiment.

As illustrated in FIG. 2 and FIG. 3, the second transfer device (collective transfer device) 50 includes a transfer roller 55 that is disposed so as to be pressed into contact with a portion of the intermediate transfer body 30 that faces the stretching roller 33 and uses the stretching roller 33 of the intermediate transfer body 30 as a counter roller 56 that forms an electrode opposite an electrode of the transfer roller 55. Here, in the present exemplary embodiment, the transfer roller 55 is formed by covering a metal shaft with an elastic layer made of foamed urethane rubber or ethylene propylene diene monomer (EPDM) rubber containing carbon black or the like, and a nip region in which the intermediate transfer body 30 is sandwiched between the transfer roller 55 and the counter roller 56 functions as a second transfer region (collective transfer region) TR.

In addition, a transfer voltage $V_{TR}$ is applied to the counter roller 56 (also serving as the stretching roller 33 in the present exemplary embodiment) from a transfer power supply 60 via a power supplying roller 57, which has electrical conductivity, in such a manner that a predetermined transfer electric field is formed between the transfer roller 55 and the counter roller 56.

Note that, in the second transfer device 50 of the present exemplary embodiment, although the transfer roller 55 is disposed so as to be pressed into contact with the intermediate transfer body 30, the present disclosure is not limited to this configuration, and it is obvious that, for example, a belt transfer module in which the transfer roller 55 is used as one of stretching rollers and in which a transfer belt is stretched between the stretching rollers may be employed.

Fixing Device

As illustrated in FIG. 2, the fixing device 70 includes a heating and fixing roller 71 that is disposed so as to be brought into contact with an image holding surface of a sheet S and that is capable of rotating as a result of being driven and a pressing and fixing roller 72 that is disposed at a position facing the heating and fixing roller 71 so as to be pressed into contact with the heating and fixing roller 71 and that rotates along with rotation of the heating and fixing roller 71. The sheet S holding an image is caused to pass through a fixing region that is formed between the fixing rollers 71 and 72, and the image is heated, pressurized, and fixed onto the sheet S.

Sheet Transport System

As illustrated in FIG. 2 and FIG. 3, the sheet transport system 80 includes a plurality of (two in the present exemplary embodiment) sheet-feeding containers 81 and 82. The sheet S fed by one of the sheet-feeding containers 81 and 82 is transported along a vertical transport path 83 extending in a substantially vertical direction and a horizontal transport path 84 extending in a substantially horizontal direction and reaches the second transfer region TR. Then, the sheet S that holds an image transferred thereto is transported by a transport belt 85 and reaches the fixing region of the fixing device 70, and the sheet S is ejected to a sheet ejection receiver 86 that is provided on the side of the image forming apparatus housing 21.

The sheet transport system 80 further includes a branched transport path 87 that branches off downward from a portion of the horizontal transport path 84, the portion being located further downstream than the fixing device 70 in a sheet-transport direction, and that enables the sheet S to be flipped over. The sheet S that has been flipped over at the branched transport path 87 returns to the vertical transport path 83 by being transported along a return transport path 88 and is transported along the vertical transport path 83 and the horizontal transport path 84 again. Then, an image is transferred onto the rear surface of the sheet S in the second transfer region TR, and the sheet S passes through the fixing device 70 and is ejected to the sheet ejection receiver 86.

The sheet transport system 80 further includes a position alignment roller 90 that aligns the position of the sheet S and that supplies the sheet S to the second transfer region TR, and each of the transport paths 83, 84, 87, and 88 is provided with a suitable number of transport rollers 91. A guide chute 93 that guides the sheet S that has passed through the position alignment roller 90 to the second transfer region TR is disposed at a position on the horizontal transport path 84 on the start side of the second transfer region TR. In the present exemplary embodiment, the single guide chute 93 is disposed between the position alignment roller 90 and the second transfer region TR, and metal chute members that are paired with each other are disposed so as to face each other, so that a guide path of the sheet S is controlled.

In addition, a manual sheet feeding unit 92 that enables manual feeding of sheets toward the horizontal transport path 84 is provided on the image forming apparatus housing 21 on the side opposite to the side on which the sheet ejection receiver 86 is provided.

Type of Sheet

Although examples of the sheet S that may be used in the present exemplary embodiment widely include a sheet having a low surface resistance value and a sheet having a high resistance value, in particular, the sheet S needs to be a sheet that may be used in an image forming apparatus that has an image formation mode (a base-image-included image formation mode) in which a base image (e.g., a white image) is formed onto a surface of a sheet and in which at least one of color images having several color components is formed onto the base image.

In the present exemplary embodiment, there is a technical problem in that a transfer failure occurs when a superposed image including a base image and a color image is transferred onto a sheet that reduces the transferability of an image (a sheet having a high resistance value and a low density), and it is found from an investigation that the cause of such a transfer failure is electric discharge that occurs during a transfer process.

In particular, a sheet that is used in the base-image-included image formation mode is, for example, a black sheet, and it is confirmed, by examining the characteristics of this type of black sheet, that a transfer failure is not observed when a black sheet having a low surface resistance value is used, whereas a transfer failure is observed when a black sheet having a high surface resistance value higher than 10 log Ω is used. Note that, although some white normal sheets and the like also have a high surface resistance value higher than 10 log Ω, since there is less need to form a base layer formed of a base image for this type of normal sheet, the above-mentioned technical problem of a transfer failure is less likely to be perceived as a problem, and a transfer failure is a new technical problem in the case of using a special sheet such as a black sheet having a high surface resistance value.

Accordingly, the present exemplary embodiment takes measures against a transfer failure that occurs when using a recording medium associated with low transferability such as, for example, a black sheet having a surface resistance value of 11 log Ω or higher, and in order to determine whether a sheet to be used is a sheet for which such measures against a transfer failure need to be taken, a sheet-type determination device 100 that determines the type of a sheet is provided as illustrated in FIG. 3.

Sheet-Type Determination Device

Figure 4A:
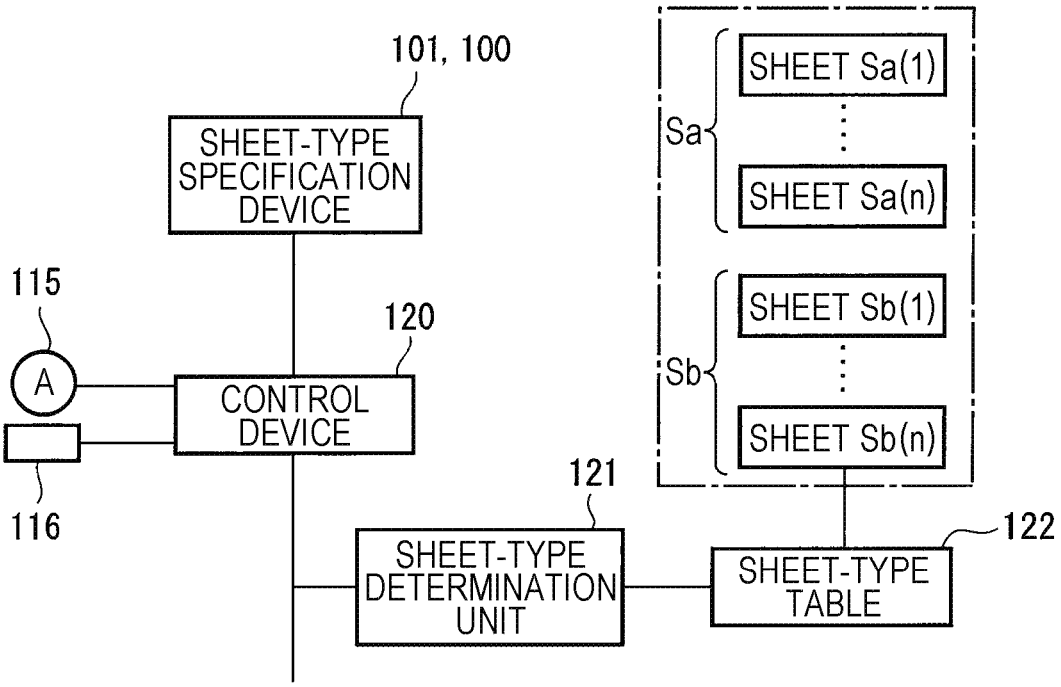
FIG. 4A is a diagram illustrating an example of processing for determining a type of sheet on the basis of information from a sheet-type specification device.

In the present exemplary embodiment, as an example of the sheet-type determination device 100, an operation panel that serves as a user interface is provided with a sheet-type specification device 101 as illustrated in FIG. 4A. Sheets that may be used in the image forming apparatus 20 are registered beforehand, and a user specifies the type of a sheet to be used among the registered sheets.

Figure 4B:
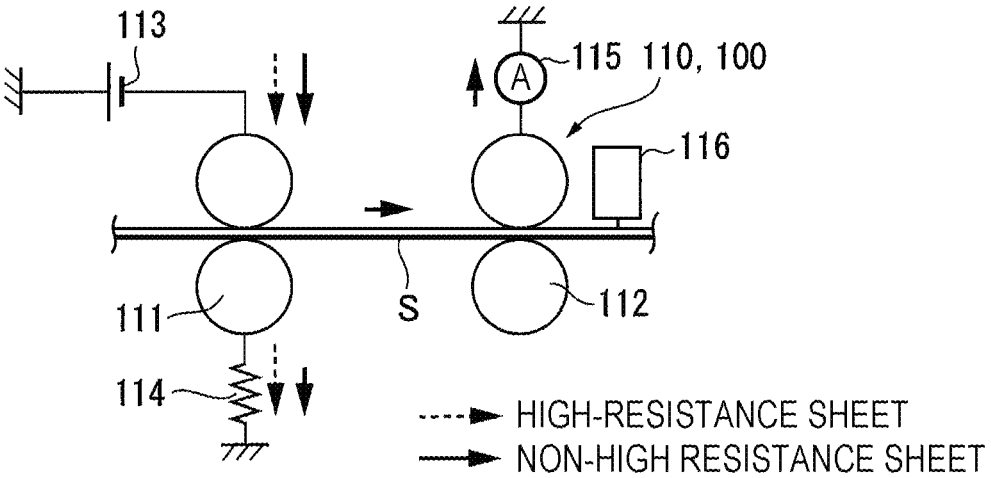
FIG. 4B is a diagram illustrating an example of the sheet-type specification device.

In addition, as illustrated in FIG. 2 and FIG. 4B, an example of the sheet-type determination device 100 is a determination device 110 that determines the type of a sheet and that is disposed at a position on the vertical transport path 83 or on the horizontal transport path 84 of the sheet transport system 80.

The determination device 110 includes a pair of determination rollers 111 and a pair of determination rollers 112 that are arranged side by side in the transport direction of the sheet S. One of the pair of determination rollers 111, which are located on an upstream side in the transport direction of the sheet S, is connected to a determination power supply 113, and the other of the pair of determination rollers 111 is grounded via a resistor 114. An ammeter 115 is disposed between one of the pair of determination rollers 112, which are located on a downstream side in the transport direction of the sheet S, and the ground. Note that the determination rollers 111 and 112 may also be used as transport members (such as the position alignment roller 90 and the transport rollers 91) for the sheet S or may be provided as different members from these transport members.

In the present exemplary embodiment, for example, assuming that a non-high resistance sheet having a surface resistance value of 10 log Ω/□ or lower is used as the sheet S, when the sheet S is disposed so as to extend across the pairs of determination rollers 111 and 112, a determination current from the determination power supply 113 flows in such a manner as to be divided into a component that flows across the pair of determination rollers 111 and a component that reaches the ammeter 115 located on the side of the pair of determination rollers 112 by flowing through the sheet S.

In contrast, assuming that a high-resistance sheet having a surface resistance value of 11 log Ω/□ or higher is used as the sheet S, since the surface resistance value of a high-resistance sheet is higher than that of a non-high resistance sheet, when the sheet S is disposed so as to extend across the pairs of determination rollers 111 and 112, the determination current from the determination power supply 113 is reduced by an amount equal to an impedance and flows across the pair of determination rollers 111, and only a small amount of the determination current reaches the ammeter 115 located on the side of the pair of determination rollers 112 by flowing through the sheet S. As a result, the surface resistance value of the sheet S is calculated by using a measured current that is measured by the ammeter 115 and an applied voltage of the determination power supply 113, so that the type of the sheet S is determined.

In addition, in the present exemplary embodiment, the determination device 110 is capable of determining whether the sheet S that is transported is black by using fluctuations in the output of an optical sensor 116 (e.g., a sensor that employs a method in which a light emitting element radiates light onto a surface of a sheet and in which a light receiving element receives the reflected light).

Driving Control System of Image Forming Apparatus

In the present exemplary embodiment, as illustrated in FIG. 3, a reference sign 120 denotes a control device that controls image formation processing that is performed by the image forming apparatus 20, and the control device 120 is formed of a microcomputer that includes a central processing unit (CPU), read only memory (ROM), random access memory (RAM), and an input/output interface. The control device 120 receives various input signals via the input/output interface, and the CPU runs an image formation control program (see FIG. 5) that is stored beforehand in the ROM. The various input signals include switch signals of a start switch (not illustrated), a mode selection switch (not illustrated), which selects an image formation mode, and the like, various sensor signals, and a sheet-type determination signal from the sheet-type determination device 100, which determines the type of a sheet. After control signals for drive control targets have been generated, the control signals are sent to the drive control targets including the image forming units 22 (22*a* to 22*f*), the transfer power supply 60, and the like.

Method of Determining Type of Sheet

In a method of determining the type of a sheet that is employed in the present exemplary embodiment, as illustrated in FIG. 4A, information items for determining the sheet S that are obtained by the sheet-type determination device 100 (the sheet-type specification device 101, the ammeter 115 of the determination device 110, and the optical sensor 116) are sent to the control device 120, and a sheet-type determination unit 121 of the control device 120 compares the sheet information items obtained by the sheet-type determination device 100 and sheet information items (which are, in the present exemplary embodiment, information items related to special high-resistance sheets Sb (SB(1) . . . Sb(n)) each of which is a black sheet having a surface resistance value of 11 log Ω/□ or higher or a sheet similar to the black sheet and information items related to non-special high-resistance sheets Sa (Sa(1) . . . Sa(n)) that do not belong to the special high-resistance sheets Sb) that are registered in a sheet-type table 122 and determines whether the sheet S to be used belongs to the special high-resistance sheets Sb. Note that examples of sheets similar to a black sheet include a gray sheet whose color is close to black and a dark, navy blue sheet, and coloring agents of these sheets may sometimes contain a conductive agent.

Operation of Image Forming Apparatus

Figure 5:
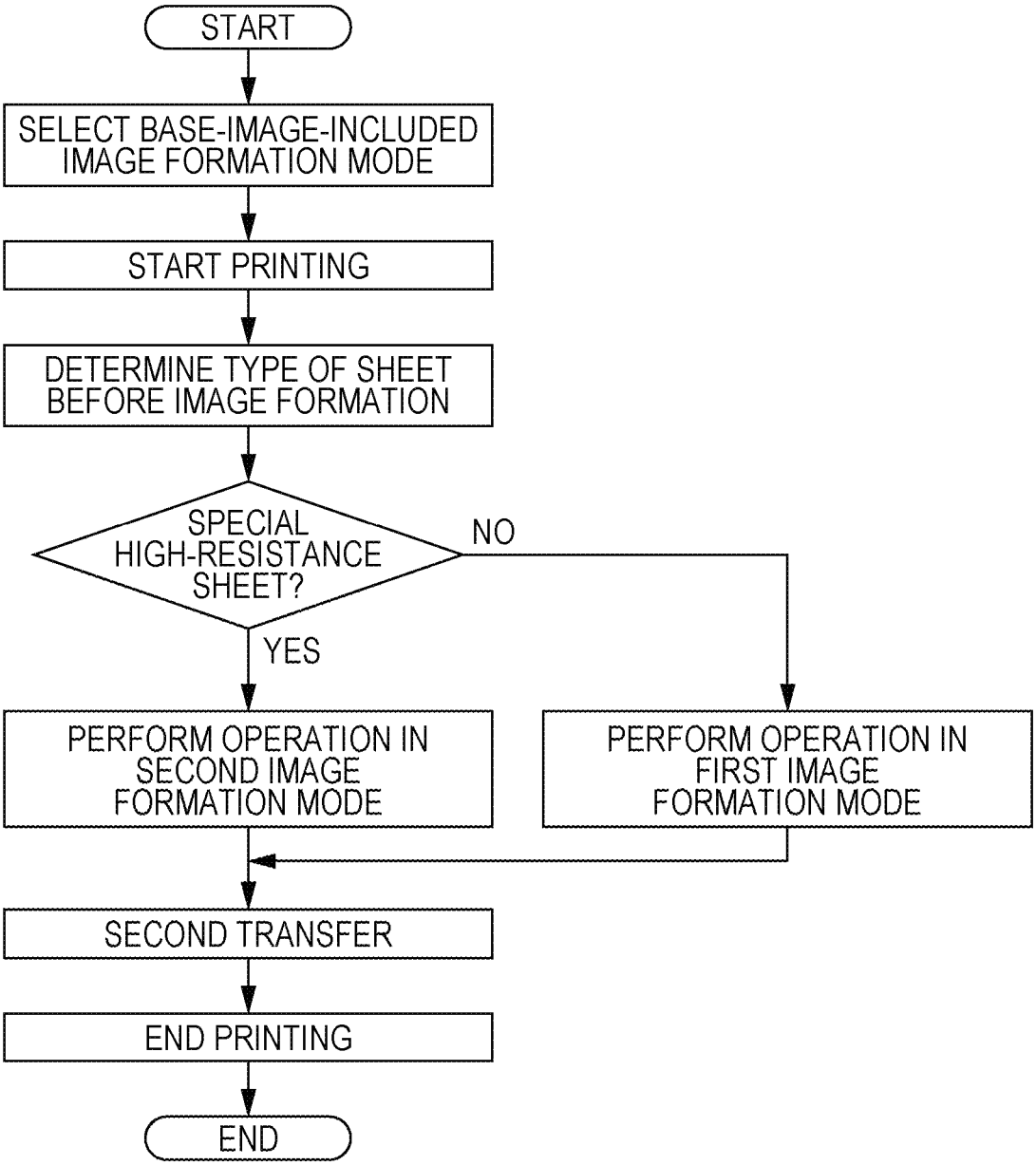
FIG. 5 is a flowchart illustrating an example of a sheet-type image forming sequence used in the image forming apparatus according to the exemplary embodiment.

Next, assume the case where different types of sheets S are used in the image forming apparatus 20, which is illustrated in FIG. 2 and FIG. 3. First, as illustrated in FIG. 5, a user selects the base-image-included image formation mode (base image+color image) by using the operation panel (not illustrated) and then switches on the start switch (not illustrated). As a result, the image forming apparatus 20 starts printing (image formation processing).

In this case, one of the sheets S is supplied by one of the sheet-feeding containers 81 and 82 or the manual sheet feeding unit 92 and transported along a predetermined transport path toward the second transfer region TR. During the transportation, for example, the determination device 110 performs processing for determining the type of the sheet S before the sheet S reaches the second transfer region TR. Note that, in addition to the processing for determining the type of the sheet S performed by the determination device 110, the user may perform an operation of specifying the type of the sheet S by using the sheet-type specification device 101.

In the present exemplary embodiment, processing for determining the type of a sheet is performed before each of the image forming units 22 (22*a* to 22*f*) performs image formation.

In the present exemplary embodiment, it is determined whether the sheet S is one of the special high-resistance sheets Sb, which are sheets associated with low transferability, and when the sheet S is not any one of the special high-resistance sheets Sb, an operation in a first image formation mode of the base-image-included image formation mode is performed. When the sheet S is one of the special high-resistance sheets Sb, an operation in a second image formation mode of the base-image-included image formation mode is performed.

Figure 6A:
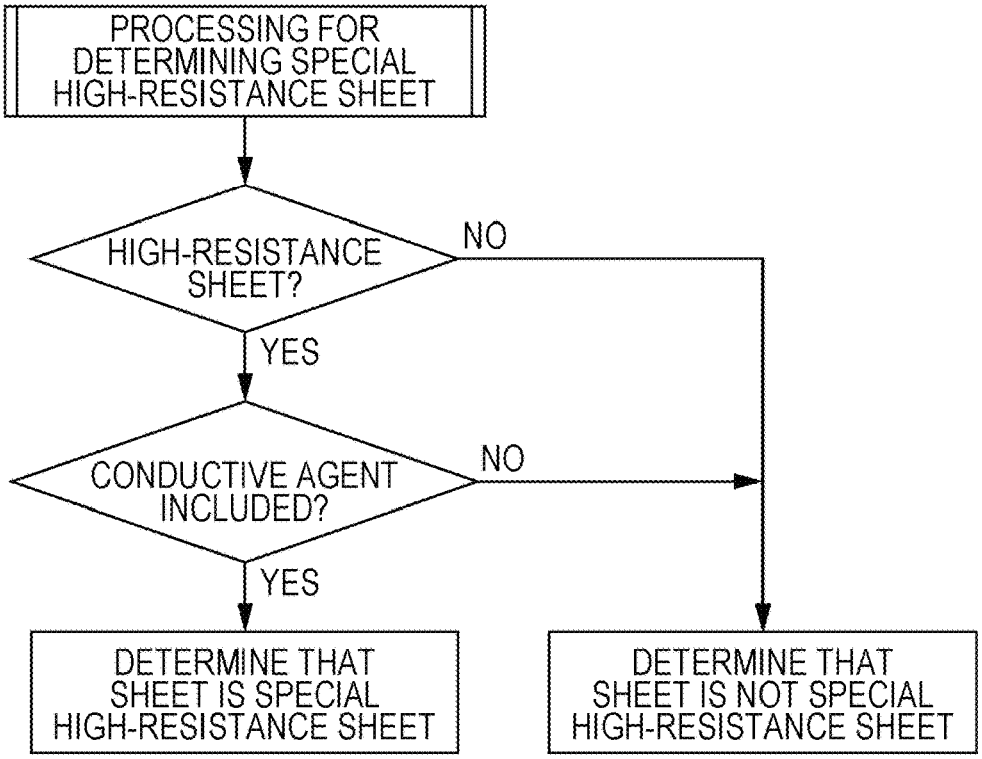
FIGS. 6A and 6B are flowcharts each illustrating an example of processing for determining a sheet that reduces the transferability of an image, the processing being included in the sheet-type image forming sequence illustrated in FIG. 5.

In the present exemplary embodiment, in the processing for determining the special high-resistance sheets Sb, as illustrated in FIG. 6A, the sheet S is determined to be one of the special high-resistance sheets Sb when the sheet S belongs to a group of high-resistance sheets each of which has a surface resistance value of 11 log Ω/□ or higher and each of which contains a conductive agent such as carbon black (e.g., the special high-resistance sheets Sb registered in the sheet-type table 122 illustrated in FIG. 4A), and when the sheet S does not belong to this group, the sheet S is determined to be one of the non-special high-resistance sheets Sa.

Figure 6B:
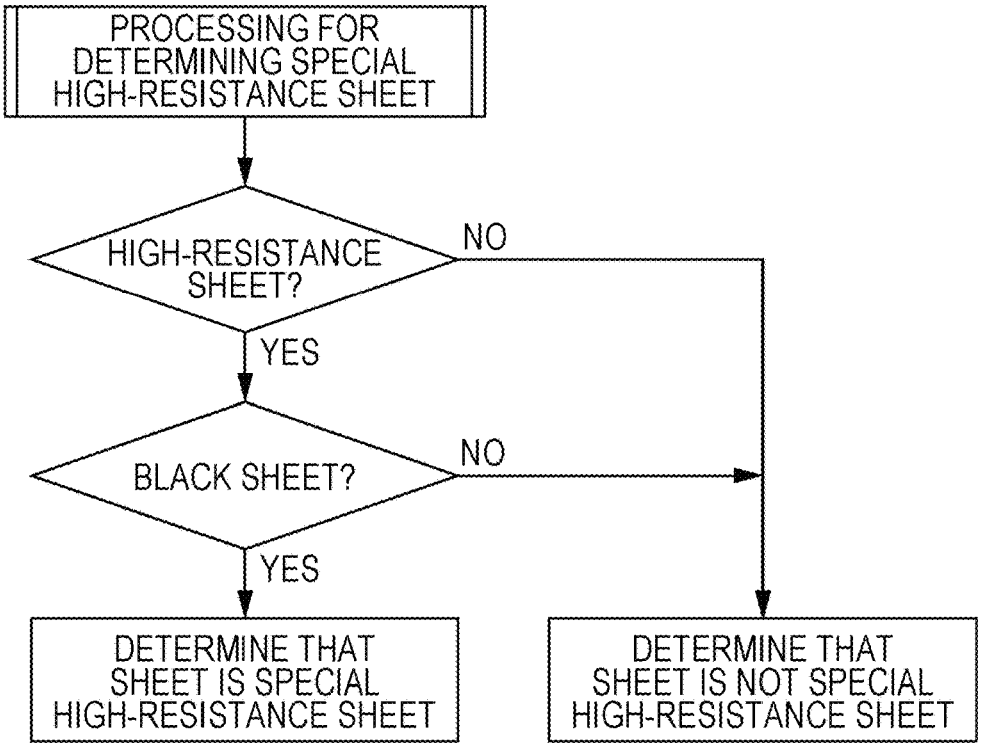

When it is assumed that the sheet S to be used is a black sheet, in the processing for determining the special high-resistance sheets Sb, as illustrated in FIG. 6B, the sheet S is determined to be one of the special high-resistance sheets Sb when the sheet S belongs to a group of sheets that are high-resistance sheets each of which has a surface resistance value of 11 log Ω/□ or higher and each of which is a black sheet (e.g., the special high-resistance sheets Sb registered in the sheet-type table 122 illustrated in FIG. 4A), and when the sheet S does not belong to this group, the sheet S is determined to be one of the non-special high-resistance sheets Sa.

<First Image Formation Mode>

Figure 7A:
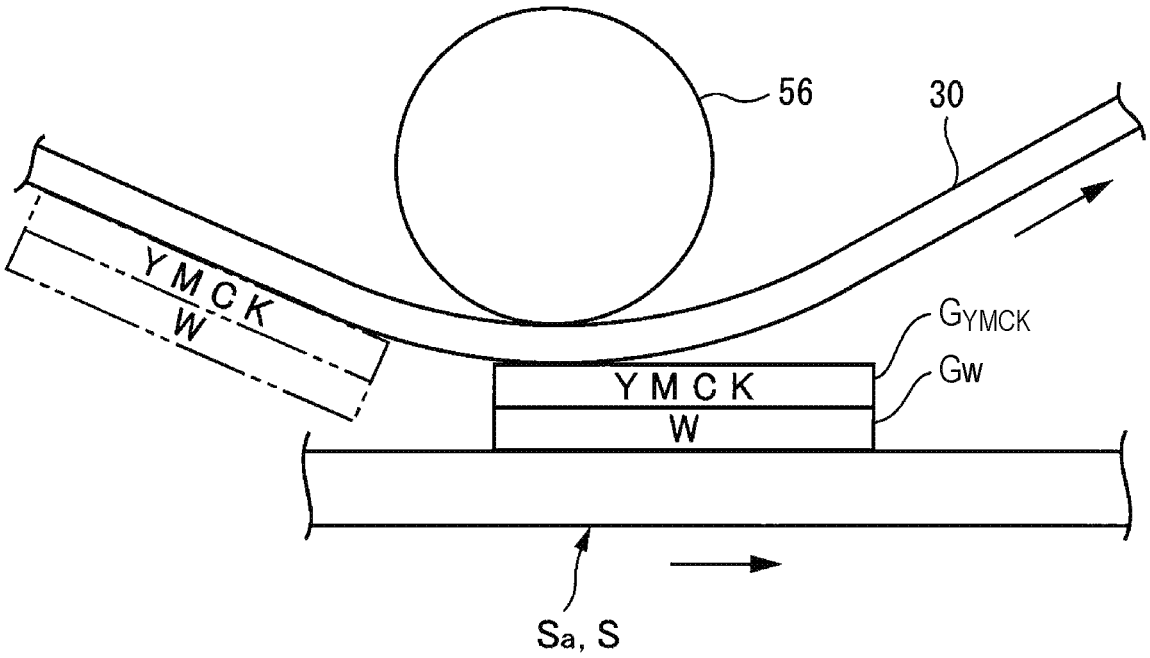
FIG. 7A is a diagram schematically illustrating an example of processing in a first image formation mode of the sheet-type image forming sequence illustrated in FIG. 5.

In the present exemplary embodiment, the first image formation mode is a base-image-included image formation mode that is selected when the sheet S is one of the non-special high-resistance sheets Sa. In the first image formation mode, for example, as illustrated in FIG. 7A, the image forming units 22*b* to 22*e* illustrated in FIG. 2 form a color image $G_{YMCK}$, which is a color image formed by using the color components (Y, M, C, and K), onto a portion of the intermediate transfer body 30 that corresponds to the entire sheet Sa (S) or a partial region of the sheet Sa (S), and the image forming unit 22*f* illustrated in FIG. 2 forms a white image Gw, which is a base image formed by using a white (W) toner, onto the color image $G_{YMCK}$. Then, the white image Gw and the color image $G_{YMCK}$ are electrostatically transferred onto the sheet Sa in the second transfer region TR.

<Second Image Formation Mode>

Figure 7B:
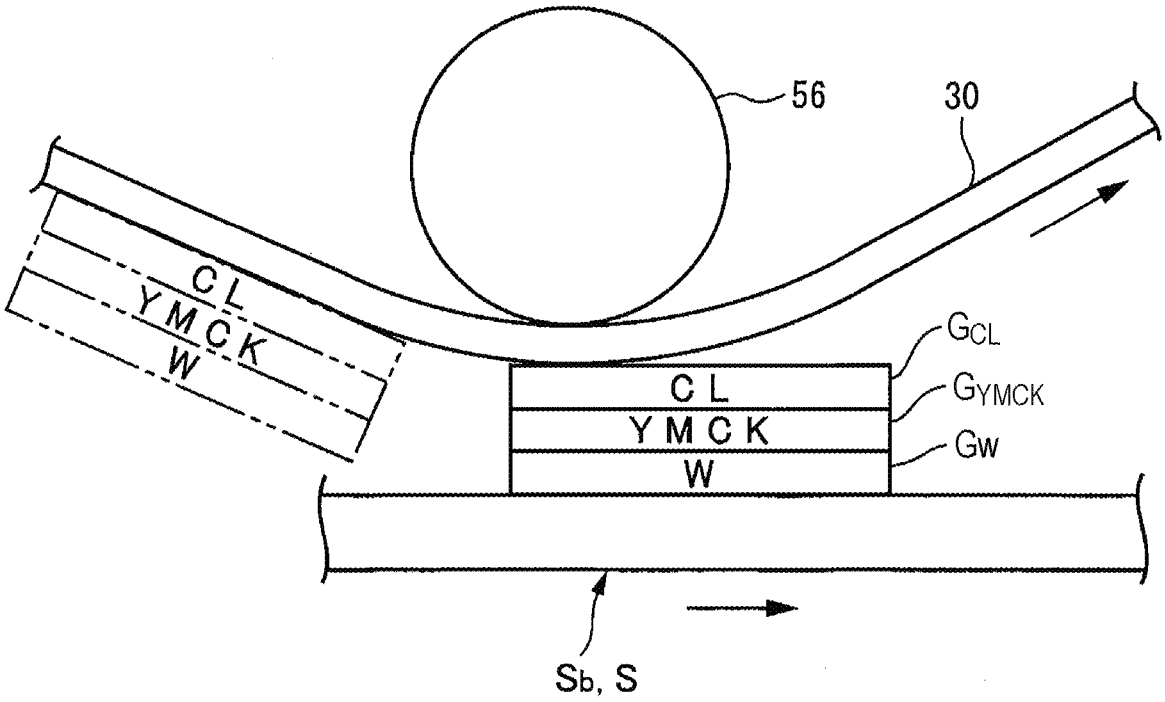
FIG. 7B is a diagram schematically illustrating an example of processing in a second image formation mode of the sheet-type image forming sequence.

In the present exemplary embodiment, the second image formation mode is a base-image-included image formation mode that is selected when the sheet S is one of the special high-resistance sheets Sb. In the second image formation mode, for example, as illustrated in FIG. 7B, the image forming unit 22*a* illustrated in FIG. 2 first forms a clear image $G_{CL}$, which is a transparent image formed by using a clear (CL) toner, onto a portion of the intermediate transfer body 30 that corresponds to the entire sheet Sb (S) or a partial region of the sheet Sb (S). Next, the image forming units 22*b* to 22*e* illustrated in FIG. 2 form the color image $G_{YMCK}$, which is a color image formed by using the color components (Y, M, C, and K), and the image forming unit 22*f* illustrated in FIG. 2 forms the white image Gw, which is a base image formed by using the white (W) toner, onto the color image $G_{YMCK}$. The white image Gw, the color image $G_{YMCK}$, and the clear image $G_{CL}$ are electrostatically transferred onto the sheet Sb in the second transfer region TR.

In particular, in the present exemplary embodiment, the weight per unit area of the white image Gw is ensured to be larger than the weight per unit area of each of the color component images included in the color image $G_{YMCK}$ so as to maintain the quality of the base image favorable. In order to easily ensure the weight per unit area of the white image Gw, a white toner having an average particle diameter larger than that of each of the other color component toners is used. The white image Gw is set such that, when the white image Gw has an area coverage of 80% or more, the white image Gw becomes a solid image after being fixed in place by the fixing device 70.

Note that this setting is common to the first image formation mode.

As described above, the operation in the first image formation mode or the operation in the second image formation mode is performed on the sheet S, and then the sheet S undergoes the second transfer process in the second transfer region TR. Then, the sheet S that has undergone the second transfer process is subjected to a fixing treatment performed by the fixing device 70 and is ejected to the sheet ejection receiver 86. As a result, the above series of printing operations (image formation processing) are completed.

Image Formation Processing in Second Image Formation Mode

Figure 8A:
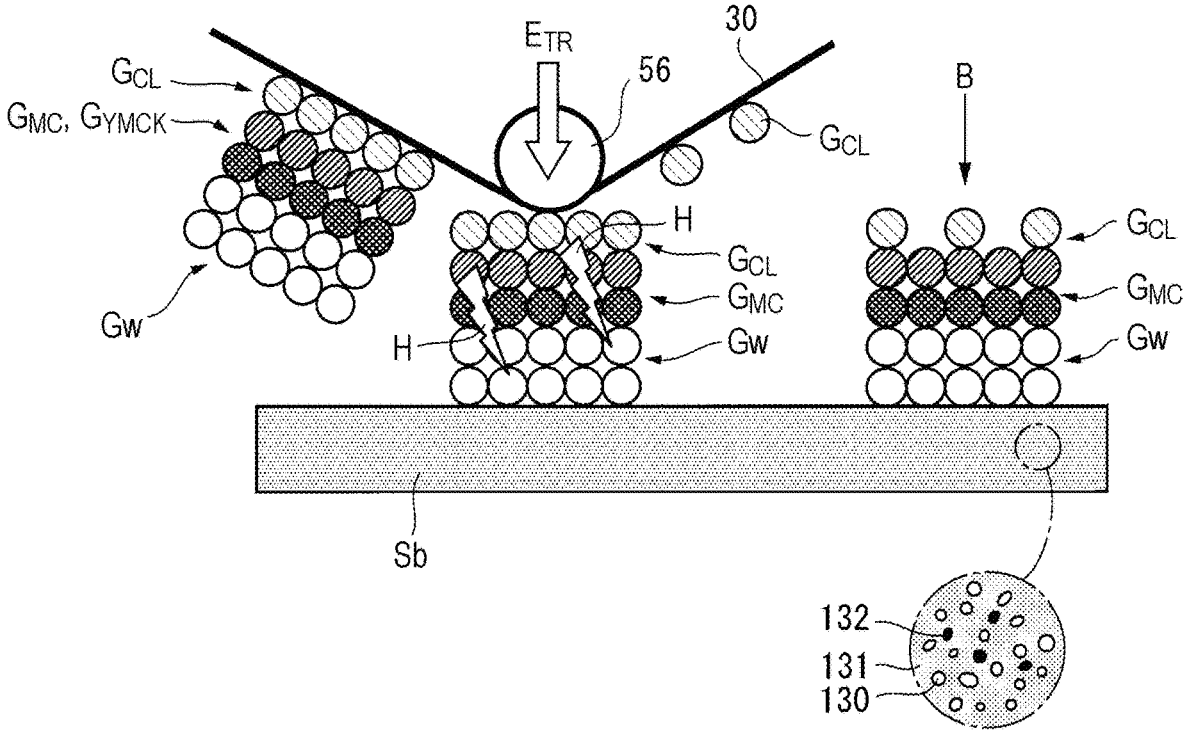
FIG. 8A is a diagram illustrating a case where an image (a superposed image formed by using a white toner, a color toner, and a transparent toner in the exemplary embodiment) that has undergone the processing in the second image formation mode of the sheet-type image forming sequence used in the exemplary embodiment is transferred in a second transfer process onto a sheet that reduces the transferability of an image.
Figure 8B:
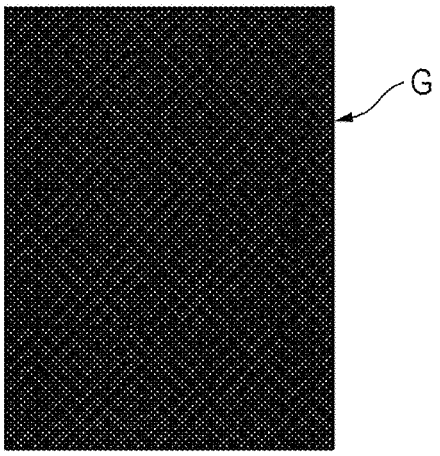
FIG. 8B is a diagram schematically illustrating the quality of an image that has been transferred to the sheet when viewed in a direction of arrow B in FIG. 8A.

Here, a process of the image formation operation in the second image formation mode will be schematically described. As illustrated in FIG. 8A, a superposed image including the clear image $G_{CL}$, the color image $G_{YMCK}$ (a blue image $G_{MC}$ formed by using a magenta (M) toner and a cyan (C) toner in the present exemplary embodiment), and the white image Gw is formed onto the intermediate transfer body 30 and transferred onto one of the special high-resistance sheets Sb in the second transfer region TR by the action of a transfer electric field $E_{TR}$.

In this case, in the special high-resistance sheet Sb, gaps 131 are present between sheet fibers 130, which are sheet base materials of the special high-resistance sheet Sb, and for example, a conductive agent 132 formed of carbon black is internally added to the fibers 130. Thus, the intensity of the transfer electric field $E_{TR}$ that is required for the special high-resistance sheet Sb having a surface resistance value of 11 log Ω or higher is relatively high. In addition, in the situation in which the gaps 131 and the conductive agent 132 are scattered in the sheet base materials, it is inevitable that abnormal electrical discharge H is likely to occur during a transfer process.

In such a situation, when the abnormal electrical discharge H occurs in the second transfer region TR, the transferability of the toner that is located at the position where the abnormal electrical discharge H has occurred deteriorates, and a portion of the clear image $G_{CL}$ deposited on a surface of the intermediate transfer body 30 remains on the surface of the intermediate transfer body 30. In this case, since the color image $G_{YMCK}$ (blue image $G_{MC}$) is formed on the intermediate transfer body 30 with the clear image $G_{CL}$ interposed therebetween, and the white image Gw is formed on the intermediate transfer body 30 with the color image $G_{YMCK}$ (blue image $G_{MC}$) interposed therebetween, the adhesion strength between the color image $G_{YMCK}$ (blue image $G_{MC}$) and the clear image $G_{CL}$ or the adhesion strength between the white image Gw and the color image $G_{YMCK}$ (blue image $G_{MC}$) is smaller than the adhesion strength between the clear image $G_{CL}$ and the intermediate transfer body 30. Thus, there is only little concern that a portion of the color image $G_{YMCK}$ (blue image $G_{MC}$) and a portion of the white image Gw will remain on the intermediate transfer body 30.

Consequently, in the present exemplary embodiment, although a portion of the clear image $G_{CL}$ is not transferred and remains on the intermediate transfer body 30 as illustrated in FIG. 8A, the transferability of the white image Gw and the transferability of the color image $G_{YMCK}$ (blue image $G_{MC}$) with respect to the special high-resistance sheet Sb are maintained. In addition, a missing portion of the clear image $G_{CL}$ does not affect the viewability, and thus, as illustrated in FIG. 8A, the image quality of the image G transferred to the special high-resistance sheet Sb is kept favorable.

Figure 9A:
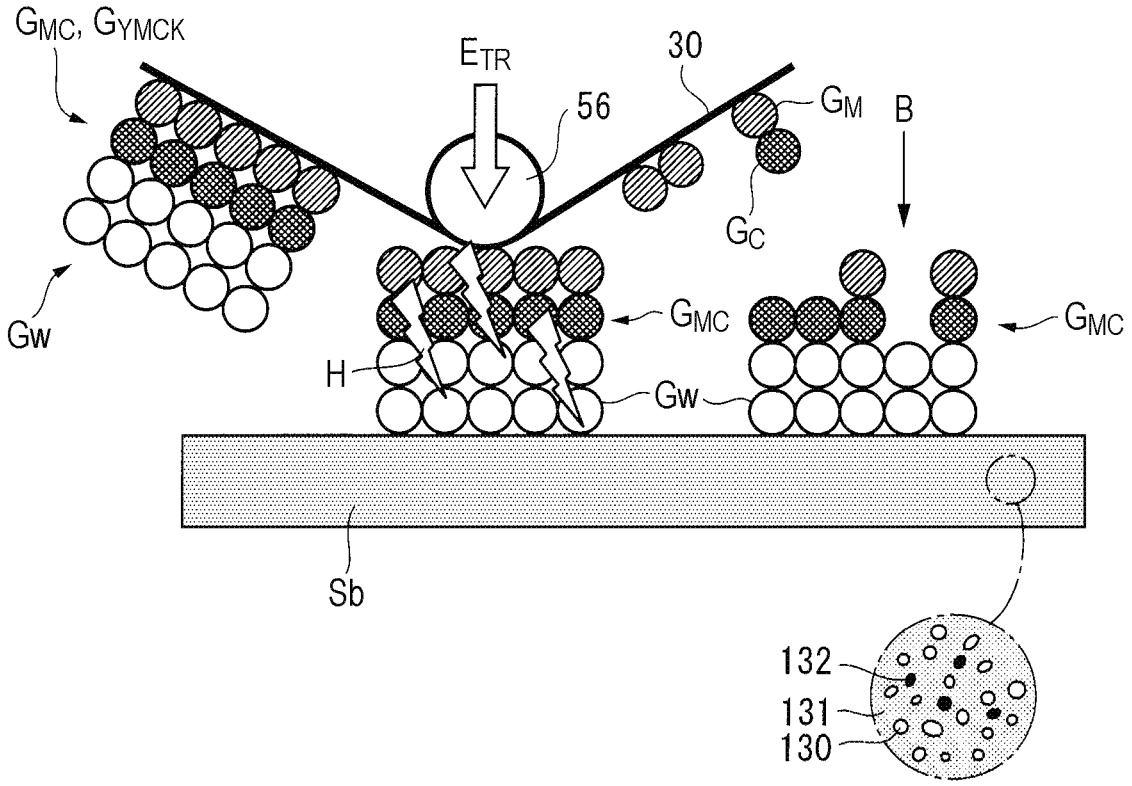
FIG. 9A is a diagram illustrating a case where an image (a superposed image formed by using a white toner and a color toner in the exemplary embodiment) that has undergone the processing in the first image formation mode of the sheet-type image forming sequence used in the exemplary embodiment is transferred in the second transfer process onto a sheet that reduces the transferability of an image.

Image Formation Processing in First Image Formation Mode for Special High-Resistance Sheet Sb When it is assumed that the image formation processing in the first image formation mode is performed on one of the special high-resistance sheets Sb, as illustrated in FIG. 9A, a superposed image including the color image $G_{YMCK}$ ((the blue image $G_{MC}$ formed by using a magenta (M) toner and a cyan (C) toner in the present exemplary embodiment) and the white image Gw is formed onto the intermediate transfer body 30 and transferred onto the special high-resistance sheet Sb in the second transfer region TR by the action of the transfer electric field $E_{TR}$.

Figure 9B:
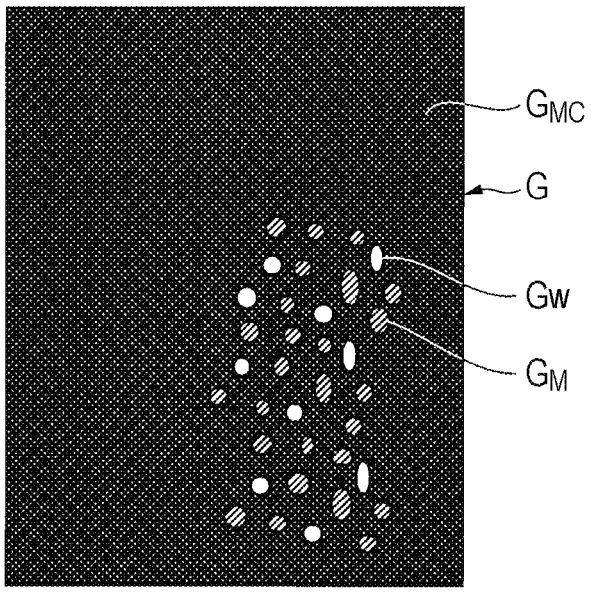
FIG. 9B is a diagram schematically illustrating the quality of the image that has been transferred to the sheet when viewed in the direction of arrow B in FIG. 9A.

In this case, when the abnormal electrical discharge H occurs in the second transfer region TR, the transferability of the toner that is located at the position where the abnormal electrical discharge H has occurred deteriorates, and a portion (a magenta toner GM or a cyan toner GC) of the color image $G_{YMCK}$ (blue image $G_{MC}$) directly deposited on the surface of the intermediate transfer body 30 is not transferred and remains on the surface of the intermediate transfer body 30. This results in occurrence of a missing portion of the color image $G_{YMCK}$ (blue image $G_{MC}$) transferred to the special high-resistance sheet Sb, and the missing portion of the color image $G_{YMCK}$ (blue image $G_{MC}$) is easily visually recognized in the transferred image G as illustrated in FIG. 9B. Consequently, the white image Gw, which is a base image, is exposed at the missing portion of the color image $G_{YMCK}$ (blue image $G_{MC}$), and there is a concern that a dot pattern may be generated in the transferred image G.

Image Formation Processing in Second Image Formation Mode for White Image

Figure 10A:
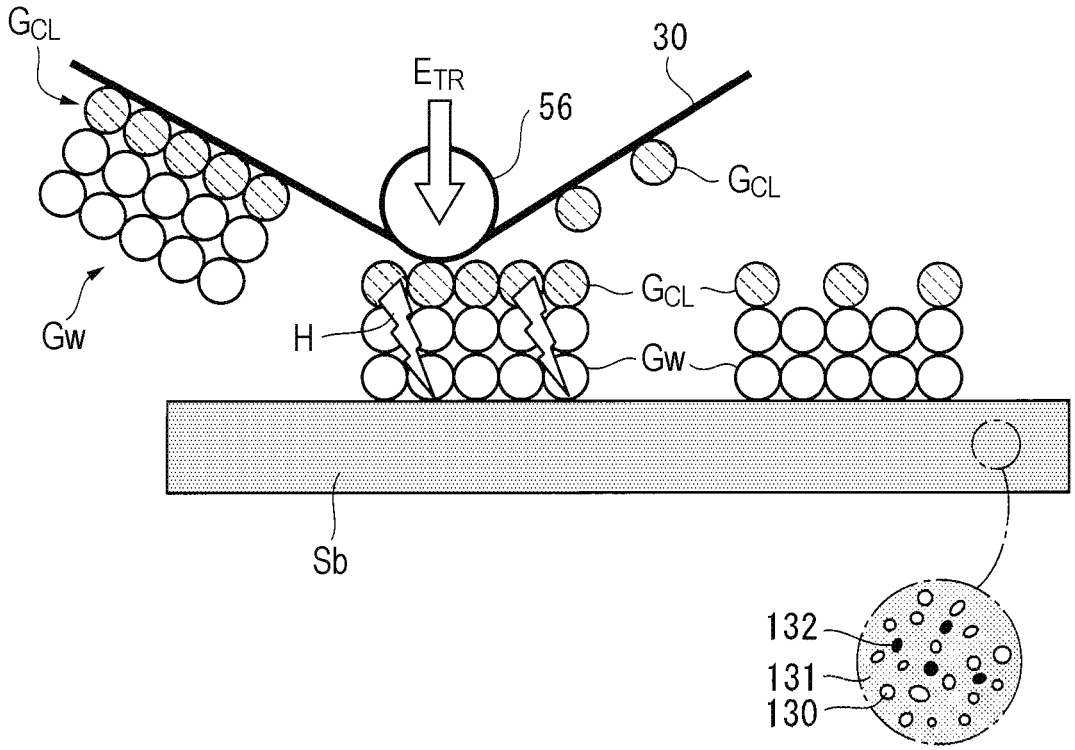
FIG. 10A is a diagram illustrating a case where an image (a superposed image formed by using a white toner and a transparent toner in the exemplary embodiment) that has undergone the processing in the second image formation mode of the sheet-type image forming sequence used in the exemplary embodiment is transferred in the second transfer process onto a sheet that reduces the transferability of an image.

When the white image Gw that is a base image on which the color image $G_{YMCK}$ is not formed is formed onto one of the special high-resistance sheets Sb, as illustrated in FIG. 10A, a superposed image including the clear image $G_{CL}$ and the white image Gw is formed onto the intermediate transfer body 30 and transferred onto the special high-resistance sheet Sb in the second transfer region TR by the action of the transfer electric field $E_{TR}$.

In this case, when the abnormal electrical discharge H occurs in the second transfer region TR, a portion of the clear image $G_{CL}$ is not transferred and remains on the surface of the intermediate transfer body 30. However, the whole white image Gw is transferred onto the special high-resistance sheet Sb, and a missing portion of the clear image $G_{CL}$ does not affects the viewability. Therefore, as illustrated in FIG. 10A, the image quality of the transferred white image Gw is kept favorable.

Figure 10B:
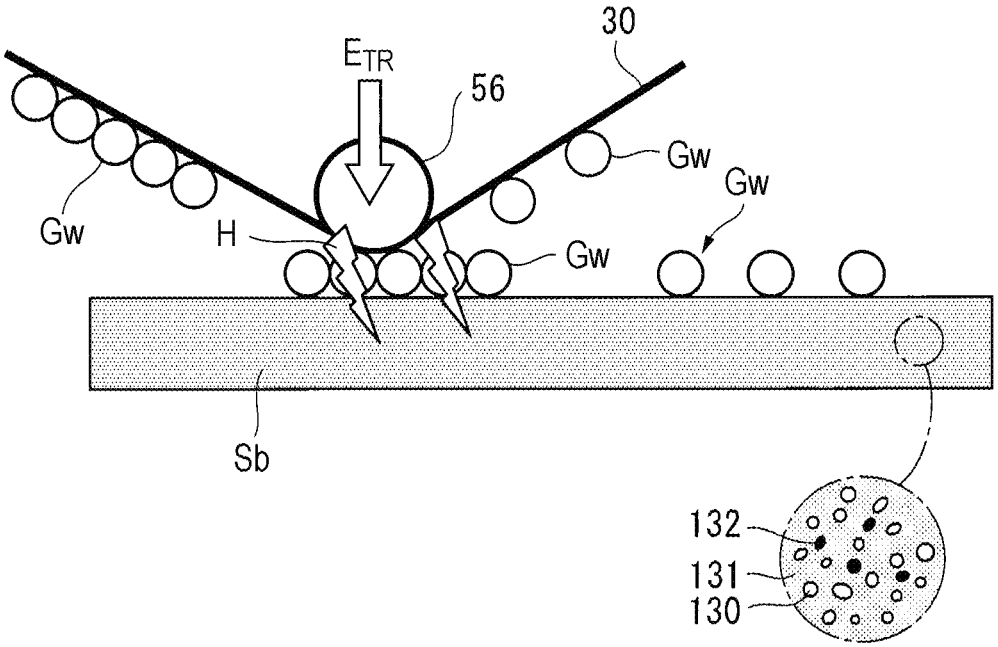
FIG. 10B is a diagram illustrating a case where an image (a monochromatic image formed by using a white toner in the exemplary embodiment) that has undergone the processing in the first image formation mode of the sheet-type image forming sequence is transferred in the second transfer process onto a sheet that reduces the transferability of an image.

In contrast, when it is assumed that the image formation processing in the first image formation mode is performed on one of the special high-resistance sheets Sb, as illustrated in FIG. 10B, the white image Gw is formed onto the intermediate transfer body 30 and transferred onto the special high-resistance sheet Sb in the second transfer region TR by the action of the transfer electric field $E_{TR}$.

In this case, when the abnormal electrical discharge H occurs in the second transfer region TR, the transferability of the toner that is located at the position where the abnormal electrical discharge H has occurred deteriorates, and a portion of the white image Gw directly deposited on the surface of the intermediate transfer body 30 is not transferred and remains on the surface of the intermediate transfer body 30. This results in occurrence of a missing portion of the white image Gw transferred to the special high-resistance sheet Sb, and the missing portions of the transferred white image Gw is easily visually recognized as illustrated in FIG. 10B. Consequently, a portion of the special high-resistance sheet Sb is exposed, and there is a concern that the quality of the white image Gw as a base image may deteriorate.

Modification

Figure 11:
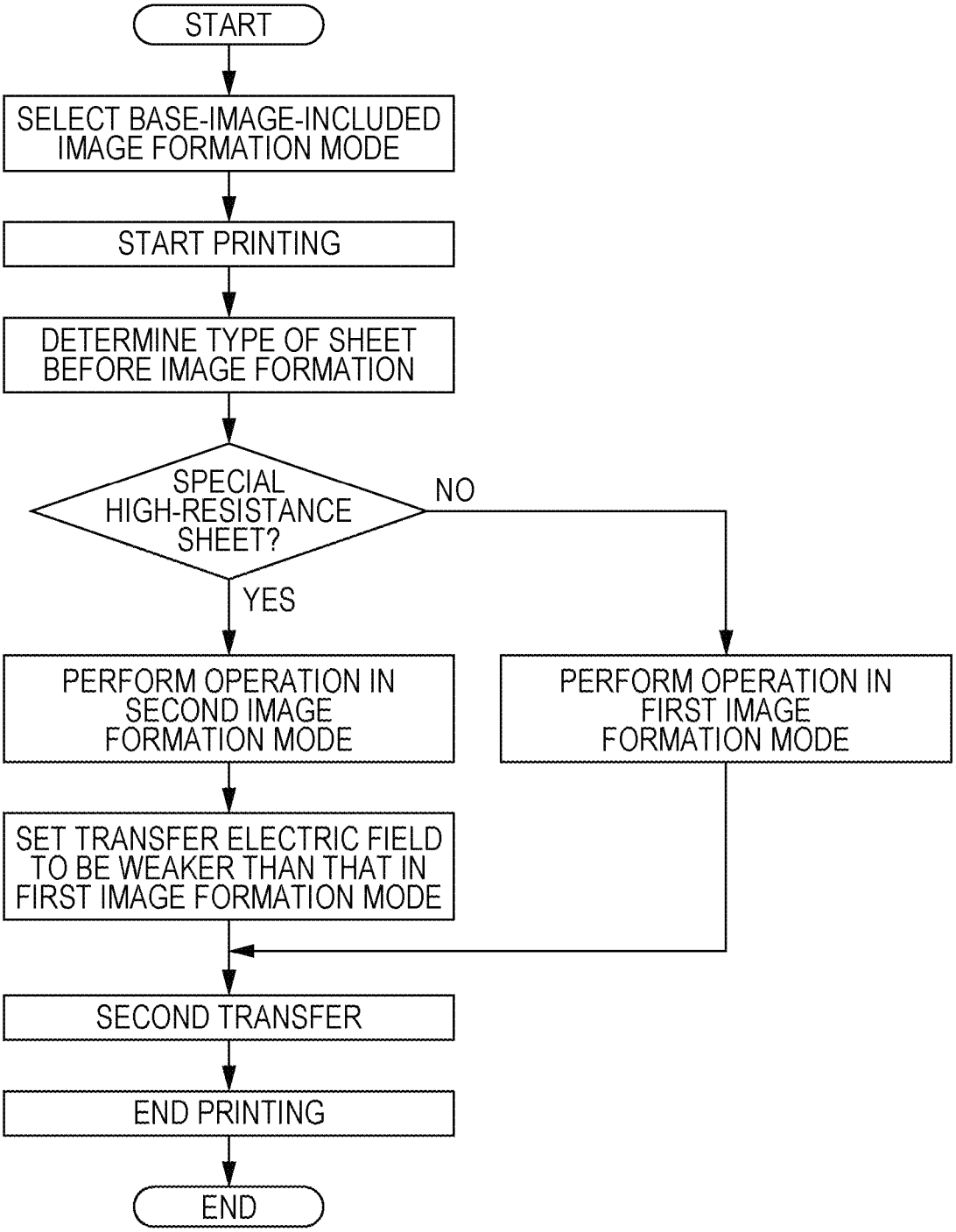
FIG. 11 is a flowchart illustrating an example of a sheet-type image forming sequence used in an image forming apparatus according to a modification.

FIG. 11 is a flowchart illustrating a sheet-type image forming sequence of an image forming apparatus according to a modification.

In FIG. 11, the basic flow of the image forming sequence is similar to that in the above exemplary embodiment. However, unlike the exemplary embodiment, the intensity of a transfer electric field in the case of performing the operation in the second image formation mode of the base-image-included image formation mode is set to be lower than that in the case of performing the operation in the first image formation mode.

This is because, in the second image formation mode, a monochromatic or polychromatic image including the white image Gw is formed onto the intermediate transfer body 30 with the clear image $G_{CL}$ interposed between the monochromatic or polychromatic image and the intermediate transfer body 30, and the images are transferred onto one of the special high-resistance sheets Sb by using the transfer electric field, and even if a portion of the clear image $G_{CL}$, which is in contact with the intermediate transfer body 30, remains untransferred, this does not directly affect the quality of the transferred image, so that the transfer electric field may be set to be lower than that in the first image formation mode.

EXAMPLE 1

In Example 1, the image forming apparatus according to the above exemplary embodiment is embodied, and the property of an image being able to be transferred when the operation in the first image formation mode as the base-image-included image formation mode is performed on various sheets having different surface resistance values is evaluated.

Figure 12:
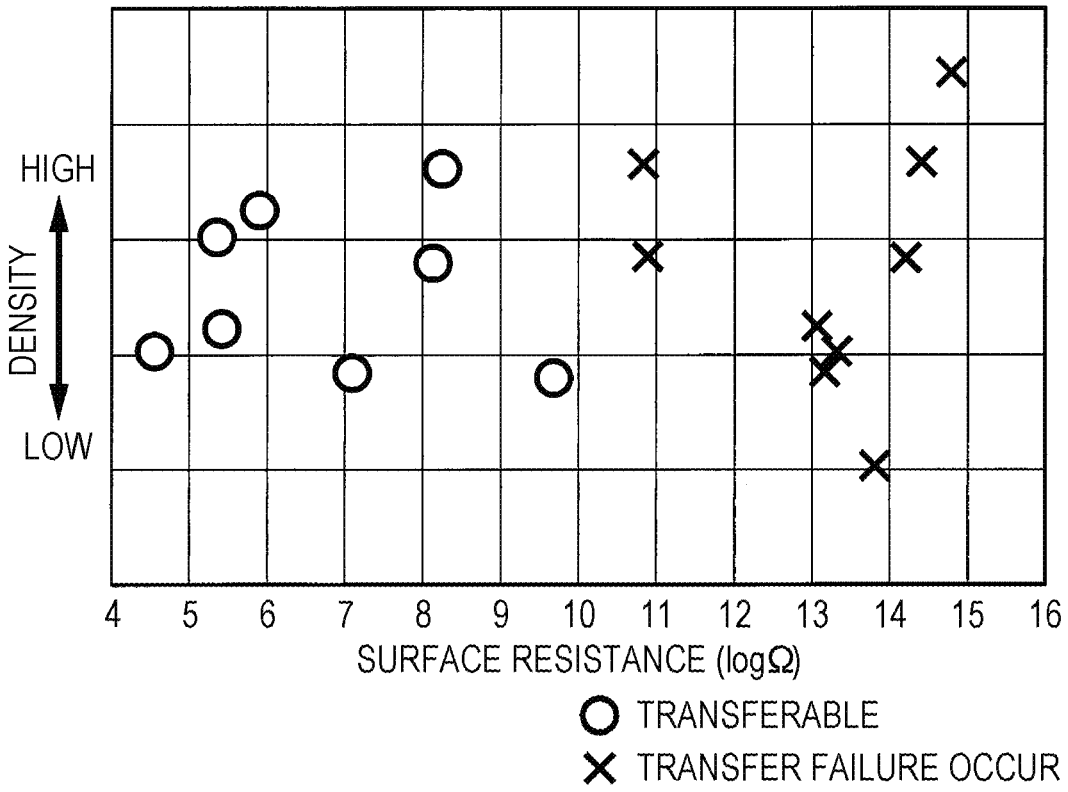
FIG. 12 is a diagram illustrating evaluation results obtained by evaluating, using an image forming apparatus according to Example 1, the property of an image being able to be transferred with respect to surface resistance values/densities of black sheets, each of which is used as a sheet.

The evaluation results are illustrated in FIG. 12.

In this evaluation, in the case of a sheet having a surface resistance value of higher than 10 log Ω, a transfer failure is observed regardless of the density of the sheet.

Accordingly, the operation in the second image formation mode is performed on a special high-resistance sheet having a surface resistance value of 11 log Ω or higher, and it is confirmed that the likelihood of occurrence of a transfer failure is reduced.

EXAMPLE 2

In Example 2, the quality of a transferred image when the operation in the second image formation mode of the base-image-included image formation mode is performed onto one of the special high-resistance sheets Sb is evaluated.

Figure 13:
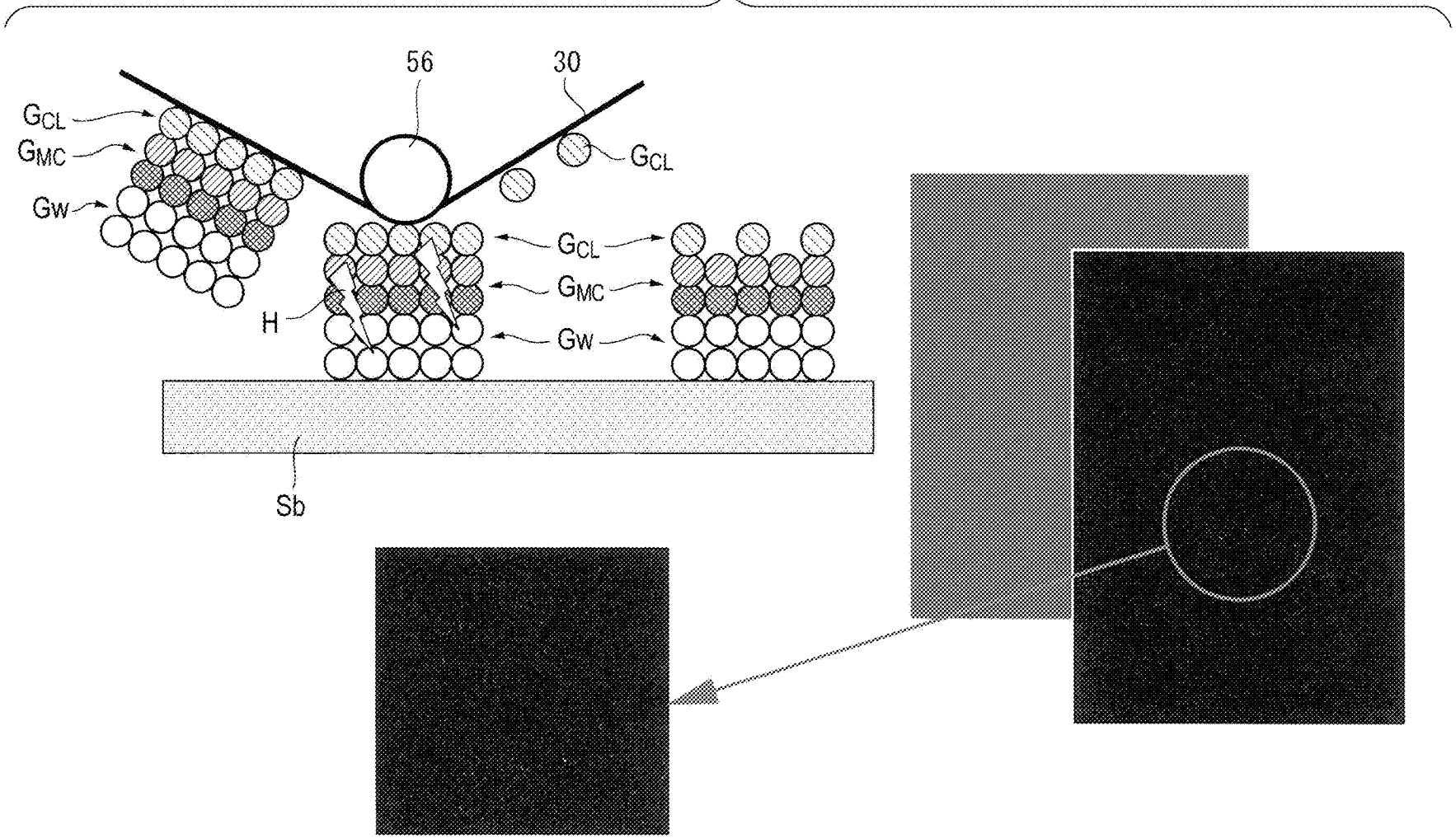
FIG. 13 is a diagram illustrating an evaluation result obtained by evaluating, using an image forming apparatus according to Example 2, the quality of an image (a superposed image formed by using a white toner, a color toner, and a transparent toner in Example 2) that has undergone the processing in the second image formation mode of the sheet-type image forming sequence and that has been transferred in the second transfer process to a sheet that reduces the transferability of an image.

In Example 2, as illustrated in FIG. 13, the clear image $G_{CL}$, the color image $G_{YMCK}$ (the blue image $G_{MC}$ formed by using a magenta (M) toner and a cyan (C) toner in Example 2), and the white image Gw are formed onto the intermediate transfer body 30, and these images are transferred onto the special high-resistance sheet Sb.

In Example 2, an image that has been transferred to the special high-resistance sheet Sb is examined, and it is confirmed that, although a portion of the clear image $G_{CL}$ remains on the intermediate transfer body 30, the quality of the transferred image is extremely favorable.

COMPARATIVE EXAMPLE

In contrast, in a comparative example, the quality of a transferred image when the operation in the first image formation mode of the base-image-included image formation mode is performed onto one of the special high-resistance sheets Sb is evaluated.

Figure 14:
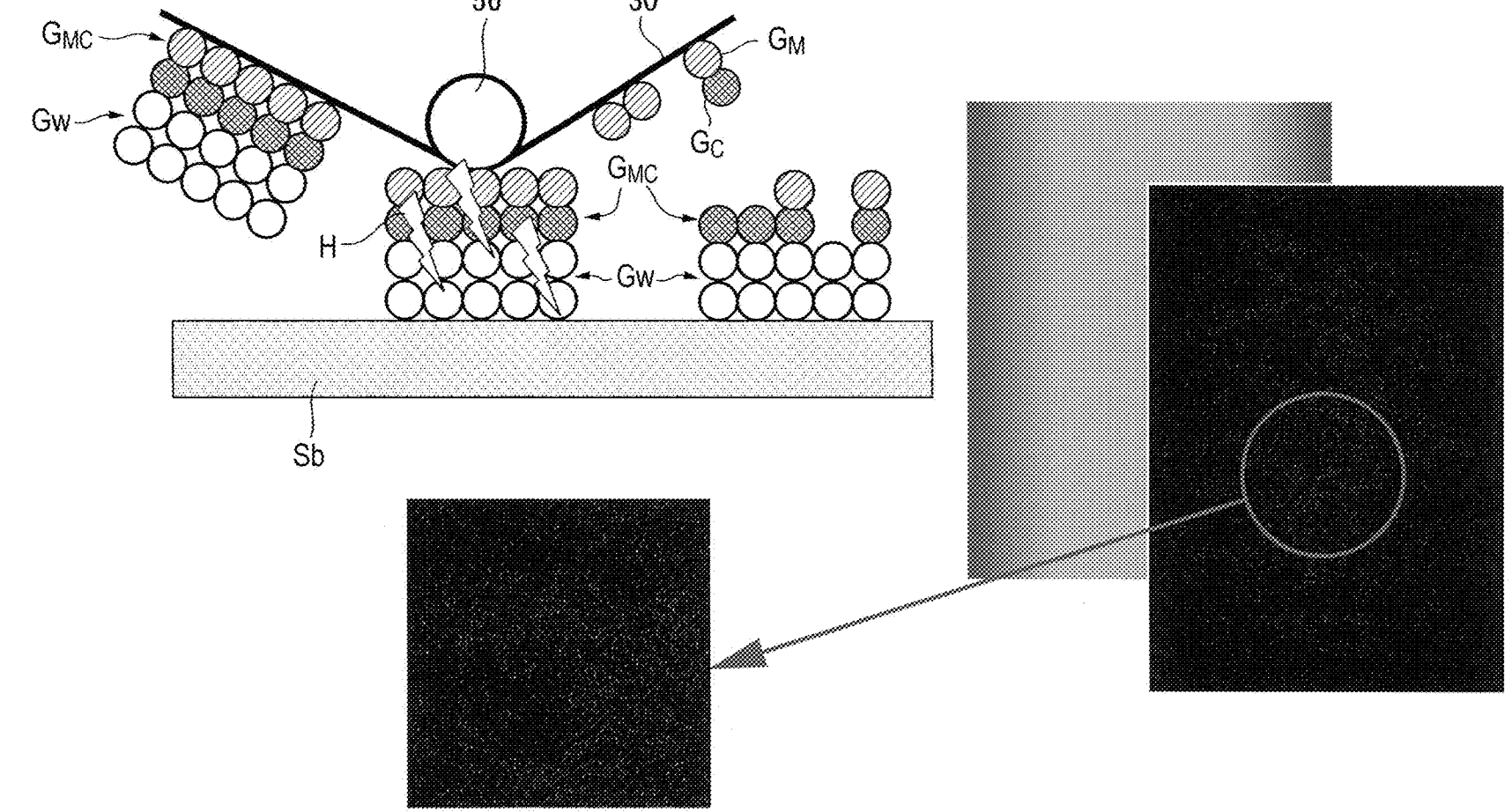
FIG. 14 is a diagram illustrating an evaluation result obtained by evaluating, using the image forming apparatus according to Example 2, the quality of an image (a superposed image formed by using a white toner and a color toner in Example 2) that has undergone the processing in the first image formation mode of the sheet-type image forming sequence and that has been transferred in the second transfer process to a sheet that reduces the transferability of an image.

In the comparative example, as illustrated in FIG. 14, the color image $G_{YMCK}$ (the blue image $G_{MC}$ formed by using a magenta (M) toner and a cyan (C) toner in Example 2) and the white image Gw are formed onto the intermediate transfer body 30, and these images are transferred onto the special high-resistance sheet Sb.

In the comparative example, an image that has been transferred to the special high-resistance sheet Sb is examined, and it is confirmed that a missing portion of the transferred blue image $G_{MC}$ as the color image $G_{YMCK}$ occurs as a result of a portion (the magenta toner GM or the cyan toner GC) of the blue image $G_{MC}$ remaining on the intermediate transfer body 30, so that a transfer failure becomes notable.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an intermediate transfer unit that holds an image to be transferred onto a recording medium;

a base image formation unit that forms a planar base image onto the intermediate transfer unit by using an opaque base image forming agent, the base image being brought into contact with and disposed onto an entire surface of the recording medium or a partial region of the surface of the recording medium;

a transparent image formation unit that forms a transparent image onto the intermediate transfer unit by using a transparent image forming agent;

a first control unit that performs control for transferring a monochromatic or polychromatic image including the base image formed on the intermediate transfer unit by the base image formation unit onto the recording medium;

a second control unit that performs control for superposing a monochromatic or polychromatic image including the base image formed by the base image formation unit onto the transparent image formed on the intermediate transfer unit by the transparent image formation unit and for transferring a monochromatic or polychromatic image including the transparent image and the base image onto the recording medium; and a selection unit that selects the first control unit or the second control unit depending on a recording medium type in response to information which indicates whether the recording medium has a high resistance value that is equal to or greater than a predetermined resistance value and includes a conductive agent contained in a medium base material of the recording medium.

2. The image forming apparatus according to claim 1, further comprising:

a color image formation unit that forms a color image onto the intermediate transfer unit by using one or a plurality of color image forming agents excluding the transparent image forming agent, wherein the first control unit performs control for superposing the base image formed by the base image formation unit onto the color image formed on the intermediate transfer unit by the color image formation unit and for transferring a polychromatic image including the color image and the base image onto the recording medium, and wherein the second control unit performs control for superposing a polychromatic image including the color image formed by the color image formation unit and the base image formed by the base image formation unit onto the transparent image formed on the intermediate transfer unit by the transparent image formation unit and for transferring a polychromatic image including the transparent image, the color image, and the base image onto the recording medium.

3. The image forming apparatus according to claim 2, wherein the base image has a weight per unit area larger than a weight per unit area of a color image layer of at least one color component of the color image.

4. The image forming apparatus according to claim 2, wherein the base image forming agent has an average particle diameter larger than an average particle diameter of the transparent image forming agent or an average particle diameter of the color image forming agent.

5. The image forming apparatus according to claim 2, wherein the base image forming agent includes a spot color that is different from the color image forming agent.

6. The image forming apparatus according to claim 1, wherein the base image forming agent is white.

7. The image forming apparatus according to claim 1, further comprising:

a fixing unit that fixes an image that has been transferred to the recording medium onto the recording medium, wherein, when the base image has an area coverage of 80% or more, the base image becomes a solid image after being fixed in position by the fixing unit.

8. The image forming apparatus according to claim 1, wherein the first control unit or the second control unit is automatically selected by the selection unit.

9. The image forming apparatus according to claim 1, wherein a transfer electric field set by the second control unit is lower than a transfer electric field set by the first control unit.

10. The image forming apparatus according to claim 1, wherein the selection unit selects the first control unit or the second control unit in response to the information whether the recording medium has a black color.

11. The image forming apparatus according to claim 10, wherein, when the recording medium has a resistance value that is lower than the predetermined resistance value and does not have the black color, the selection unit selects the first control unit.

12. The image forming apparatus according to claim 1, wherein the selection unit selects the first control unit or the second control unit in response to the information whether the recording medium includes carbon black.

13. The image forming apparatus according to claim 12, wherein, when the recording medium has a resistance that is lower than the predetermined resistance value and does not include carbon black contained in the medium base material of the recording medium, the selection unit selects the first control unit.

14. The image forming apparatus according to claim 1, wherein, when the recording medium has a resistance value that is lower than the predetermined resistance value and does not include the conductive agent contained in the medium base material of the recording medium, the selection unit selects the first control unit.

15. The image forming apparatus according to claim 1, further comprising a sheet-type determination device configured to determine the information.

16. An image structure that is obtained by transferring an image formed on an intermediate transfer unit onto a recording medium having a high resistance value equal to or greater than a predetermined resistance value and including a conductive agent contained in a medium base material of the recording medium by using an image forming apparatus including the intermediate transfer unit that holds an image to be transferred onto a recording medium, a base image formation unit that forms a base image onto the intermediate transfer unit by using a base image forming agent excluding a transparent image forming agent, the base image being brought into contact with and disposed onto an entire surface of the recording medium or a partial region of the surface of the recording medium, a transparent image formation unit that forms a transparent image onto the intermediate transfer unit by using the transparent image forming agent, and a color image formation unit that forms a color image onto the intermediate transfer unit by using one or a plurality of color image forming agents excluding the transparent image forming agent, wherein the transparent image is directly superposed on the base image on a surface of the recording medium or is superposed on the base image on the surface of the recording medium with the color image interposed between the transparent image and the base image.

17. The image structure according to claim 16, wherein the base image has a weight per unit area larger than a weight per unit area of a color image layer of at least one color component of the color image.

18. An image forming apparatus comprising:

intermediate transfer means for holding an image to be transferred onto a recording medium;

base image formation means for forming a planar base image onto the intermediate transfer means by using an opaque base image forming agent, the base image being brought into contact with and disposed onto an entire surface of the recording medium or a partial region of the surface of the recording medium;

transparent image formation means for forming a transparent image onto the intermediate transfer means by using a transparent image forming agent;

first control means for performing control for transferring a monochromatic or polychromatic image including the base image formed on the intermediate transfer means by the base image formation means onto the recording medium;

second control means for performing control for superposing a monochromatic or polychromatic image including the base image formed by the base image formation means onto the transparent image formed on the intermediate transfer means by the transparent image formation means and for transferring a monochromatic or polychromatic image including the transparent image and the base image onto the recording medium; and selection means for selecting the first control means or the second control means depending on a recording medium type in response to information which indicates whether the recording medium has a high resistance value that is equal to or greater than a predetermined resistance value and includes a conductive agent contained in a medium base material of the recording medium.

* * * * *